US007887251B1

(12) United States Patent
Wang

(10) Patent No.: US 7,887,251 B1
(45) Date of Patent: Feb. 15, 2011

(54) HYDRAULIC MANHOLE ASSEMBLY

(76) Inventor: Tsung-Hua Wang, P.O. Box 166-13, Taipei (TW) 115

( * ) Notice: Subject to any disclaimer, the term of this patent is extended or adjusted under 35 U.S.C. 154(b) by 0 days.

(21) Appl. No.: 12/572,274

(22) Filed: Oct. 2, 2009

(51) Int. Cl.
*E02D 29/14* (2006.01)

(52) U.S. Cl. ..... 404/25

(58) Field of Classification Search ..... 404/25, 404/26; 137/371; 52/20
See application file for complete search history.

(56) References Cited

U.S. PATENT DOCUMENTS

| | | | | |
|---|---|---|---|---|
| 314,781 | A * | 3/1885 | Beckwith | 404/25 |
| 5,507,590 | A * | 4/1996 | Argandona | 404/25 |
| 5,788,406 | A * | 8/1998 | Hernandez | 404/25 |
| 5,941,024 | A * | 8/1999 | Journault | 52/20 |
| 7,094,000 | B2 * | 8/2006 | Akkala et al. | 404/25 |
| 7,108,447 | B2 * | 9/2006 | Akkala et al. | 404/25 |
| 7,448,512 | B2 * | 11/2008 | Hauer et al. | 220/817 |
| 7,744,304 | B2 * | 6/2010 | Akkala et al. | 404/25 |
| 2008/0098662 | A1 * | 5/2008 | Laffitte Figueras | 52/20 |

* cited by examiner

*Primary Examiner*—Gary S Hartmann

(57) ABSTRACT

A manhole assembly which is designed to be opened with less strength consists of a circular frame (1) with a cup (11) provided on an end, and a cover (2) with an arm (21) which joints said cup (11) provided on an end thereof, characterized in that a first bracket (12) is disposed in an inner wall of the frame (1) where the cup (11) is provided, and a second bracket (22) is provided on a bottom of the cover (2). A hydraulic device (3) is provide therebetween and pin joints with both first and second brackets (12, 22) respectively, and a locking mechanism (4) is disposed on an opposite end of the arm (21) for sealing the cover (2) and frame (1) tightly.

8 Claims, 4 Drawing Sheets

HYDRAULIC MANHOLE ASSEMBLY

FIELD OF THE INVENTION

The present invention relates to a manhole assembly equipped with a hydraulic system for lifting the manhole cover with less strength.

BACKGROUND OF THE INVENTION

A manhole is usually placed in street as a top opening for providing easy access and maintenance to the underground structure such as pipe line or sewer. The manhole is sealed by a manhole cover to avoid the falling of pedestrian or object, the manhole cover is commonly made of solid steel to support the weight of vehicles which pass over everyday. However, heavy cover also requires greater strength when it has to be removed; maintenance staff is usually equipped with basic tool such as crowbar to lift the lid. The force needed to remove the cover is slightly reduced but it still requires a strong person for operating and the disengagement of the crowbar with cover may injure the worker. Some apparatus have also be invented such as cited U.S. Pat. No. 6,202,598, entitled "APPARATUS FOR REMOVAL OF VAULT LIDS AND OTHER HEAVY COVERS", filed by Chong et al. or U.S. Pat. No. 5,788,406, entitled "DOUBLE PIVOT SEMI-AUTOMATIC MANHOLE COVER LIFTING DEVICE", filed by Manuel Andres Hernandez. The apparatus disclosed by Chong et al. using principle of lever, wherein wheels 20*a*, 20*b* served as fulcrum, a handle member 12 functioned as a lever and a hook member for lifting the cover. The apparatus allows the working staff to remove the cover easier than using a crowbar and is cost effective. However, the hook member 16 can be bent or broken under frequent uses which means constant maintenance and parts replacement are required. From an aspect of long term, the economic value thereof is doubtful. Further, for working in several locations in a same time, the staff team must carry multiples apparatus to save time, occupied extra space for storage and generated extra weight. Moreover, either crowbar or apparatus disclosed by Chong et al. requires a hole to be provided on the cover for engaging with the tool. The hole may allow water or other liquid penetrating the underground structure and causing damage. As disclosed in U.S. Pat. No. 5,788,406, Hernandez disclosed a manhole cover which can be lifted by a spring 84 and supported by a bar assembly 86. The user may only needed to pull and rotate the cover until its position is fixed by the bar assembly 86. To pull a cover which commonly weights 150 Kg (about 330 lbs) is relatively easier than to lift it. However, it still requires plenty strength for operating the device. Besides, the device doesn't provide any watertight feature which increases the possibility of corroding the spring 84 and bar assembly 86 by moisture, causing mal function of the device and endangering the safety of the personnel who performs maintenance. Therefore, to provide a manhole cover heavy to bear the car passing by and easy to lift with water tight feature has become the objectives of the present invention.

SUMMARY OF THE INVENTION

To achieve foregoing objectives, the manhole assembly of the present invention comprises mainly a circular frame (1), a cover (2) and a hydraulic device (3). The frame (1) is provided with a cup (11) and the cover (2) is provided with an arm (21), the cup (11) and arm (21) can be hinged for coupling both the frame (1) and cover (2). Two ends of the hydraulic device (3) are fixed with the frame (1) and cover (2) by engaging and jointing with two brackets (12, 22) provided respectively in an inner wall of the frame (1) and on a bottom of the cover (2). By setting the hydraulic device (3) therebetween, the cover (1) is lifted by the force generated from the hydraulic system, allowing the maintenance staff to use minimum force to open the manhole cover (2). A locking mechanism (4) is disposed at the top of the cover (2) for maintaining and securing the cover (2) in closed state. The locking mechanism (4) consists of a locking unit (42), a hole (41) provided on the manhole cover (2) for receiving the locking unit (42), a support (44) having a passage hole (45) for receiving the locking unit (42) and a slot (43) provided on the inner wall of the frame (1) for engaging with the support (44). For providing water-tight feature, the locking unit (42) is coupled with a gasket to prevent the penetration of any liquid from the top of the cover (2). Further, a circular groove (15) is provided around the frame (1) which can guide liquid into the cup (11) where a water outlet (14) is disposed at the bottom to lead the liquid out.

DETAILED DESCRIPTION OF PREFERRED EMBODIMENT

Figure 1:
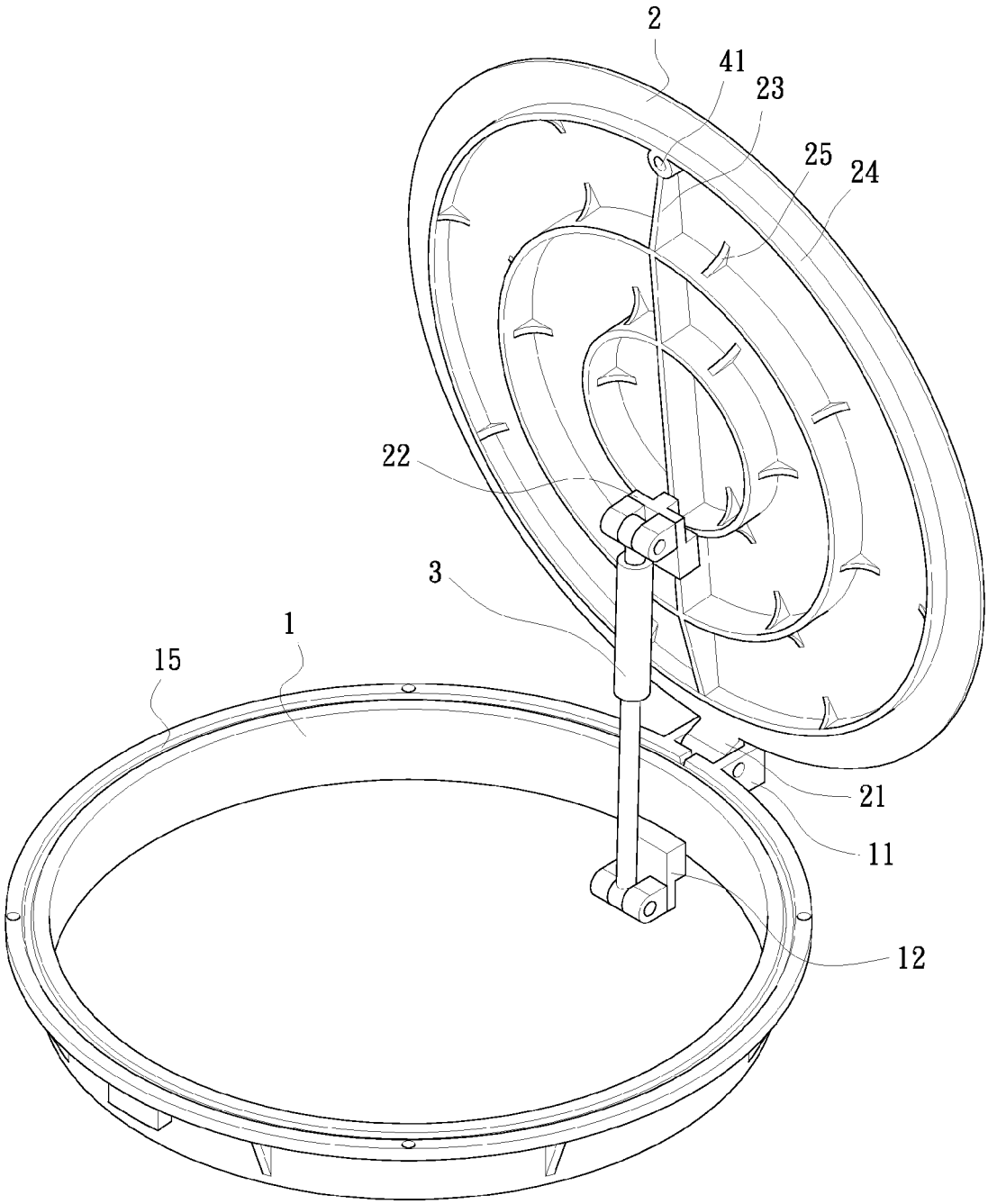
FIG. 1 is a perspective view of the preferred embodiment of the present invention.
Figure 2:
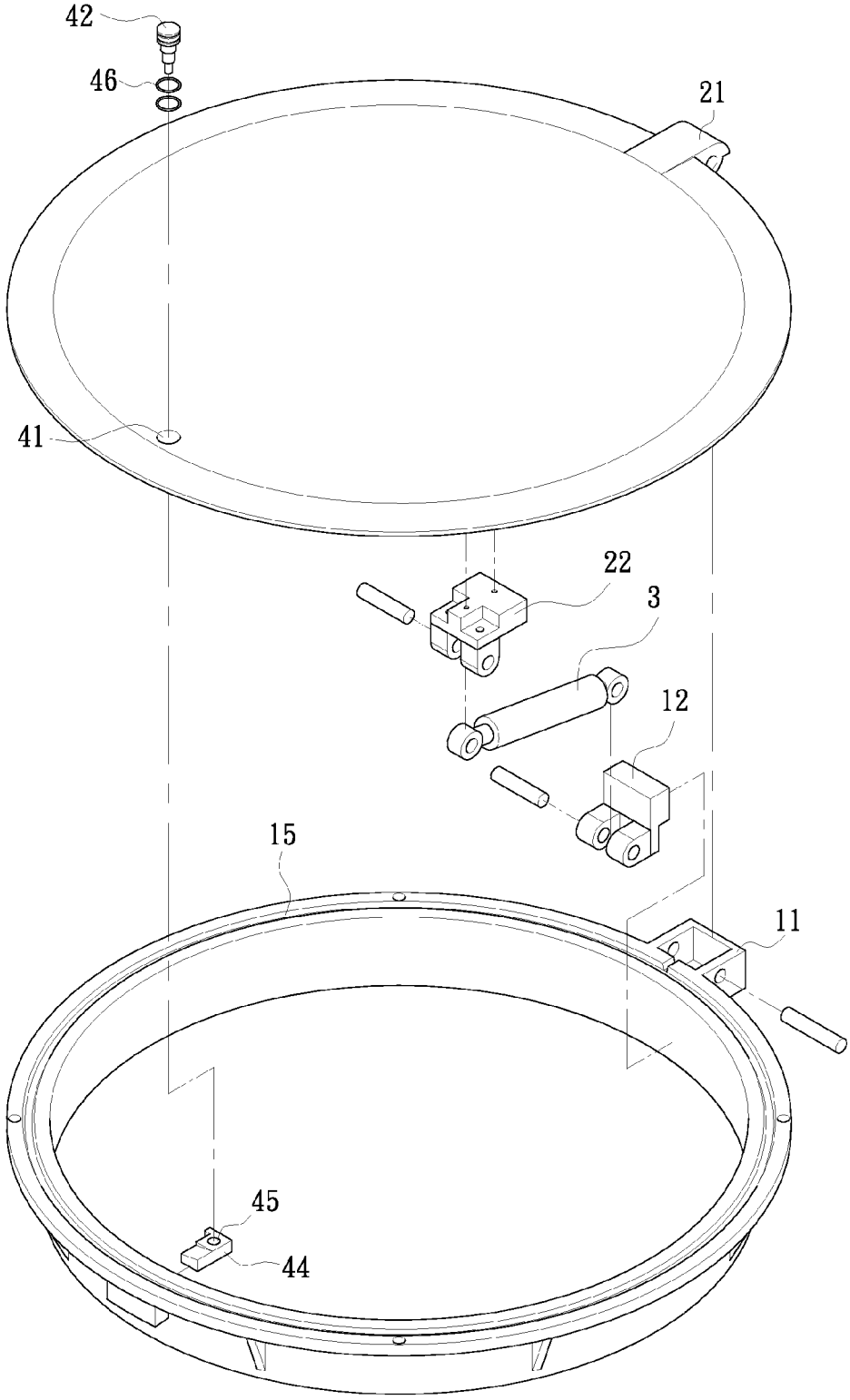
FIG. 2 is an exploded view of the preferred embodiment of the present invention.
Figure 3:
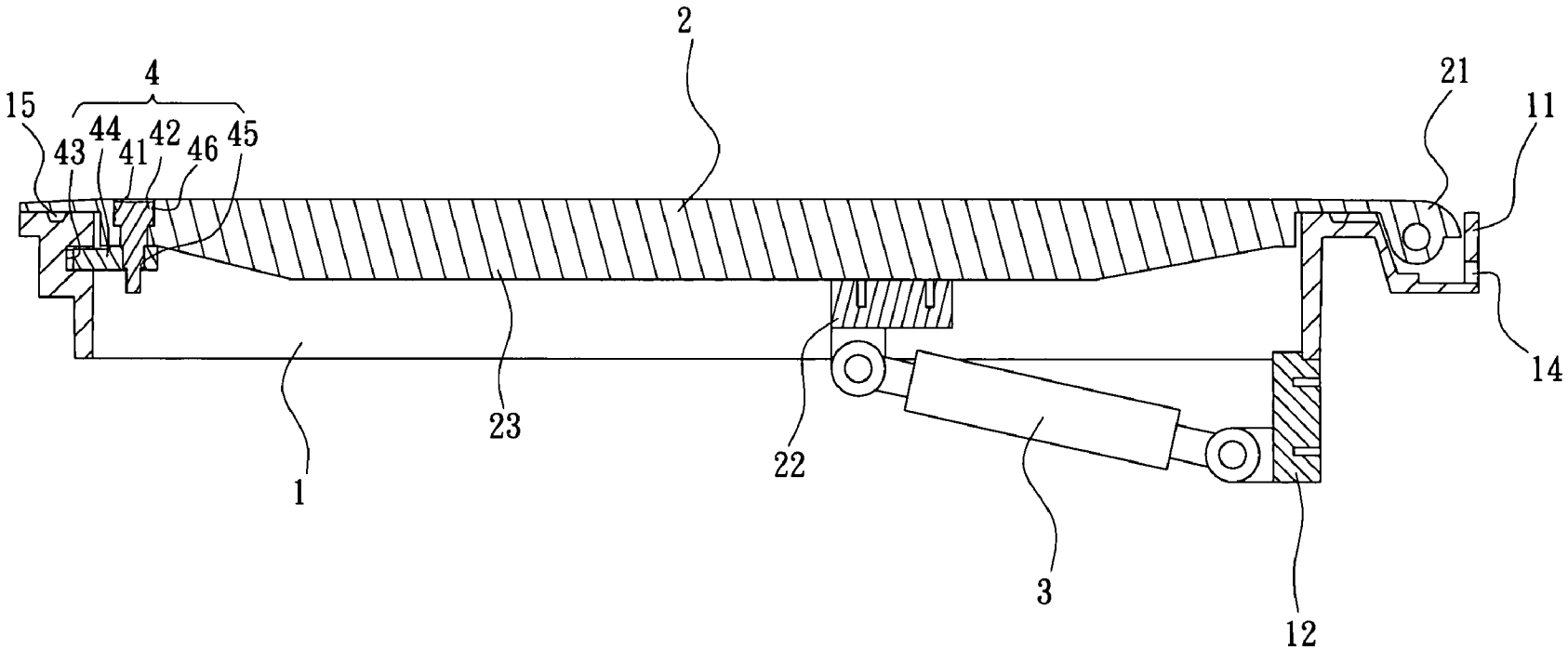
FIG. 3 is a cross sectional view of the preferred embodiment of the present invention.

Referring to FIGS. 1-3, an easy-lift manhole assembly consists of a circular manhole frame (1) with a cup (11) provided on an end, and a manhole cover (2) having an arm (21) projected from an end. Said cup (11) serves as a support to receive the arm (21) allowing the cover (2) hinged to the frame (1). The manhole assembly is characterized in that a first bracket (12) is disposed in an inner wall of the frame (1) where the cup (11) is provided, and a second bracket (22) is provided on a bottom of the cover (2). A hydraulic device (3) is provided therebetween to engage both frame (1) and cover (2) by pin jointing with the first and second brackets (12, 22) respectively with both distal ends thereof. A locking mechanism (4) is disposed on an opposite end of the arm (21) for sealing the cover (2) and frame (1) tightly.

By installing a hydraulic device (3), the hydraulic force is able to lift the manhole cover (2) and allows maintenance staff applying minimum force to open the heavy manhole cover and obtain access to the underground structure performing duty without specific tool or possibility being injured if the cover disengages with the tool. However, the lifting force of the hydraulic system (3) is preferably a little bit weaker than the weight of the manhole cover (2). Such setting can prevent excess force lifting the cover (2) suddenly and endanger the personnel nearby; it also facilitates the closing of the manhole cover (2) as with the weight of the cover (2) and a slight push of the user, the cover (2) is able to be closed.

The locking mechanism (4) includes a hole (41) provided on the cover (2), a locking unit (42) disposed inside the hole (42), a support (44) provided with a passage hole (45) for receiving the locking unit (42) and a slot (43) provided on the inner wall of the frame (1) for engaging with the support (44).

By incorporating the locking mechanism (4), the manhole cover (2) is maintained in sealed position to provide a tight closure so movement of the cover (2) or noise is avoided when vehicles passing above and prevent from being lifted by the hydraulic device (3) solely, endangering pedestrians or vehicles on the street.

The manhole assembly also includes a watertight feature by coupling the locking unit (42) with a gasket (46) and setting a groove (15) around the circumference of the frame (1) which connects with the cup (11). The gasket (46) sealed the hole (42) to prevents any liquid on top of the manhole cover (2) penetrates and damages underground structure or equipment. The groove (15) collects the liquid and guides it to the cup (11). A water outlet (14) is provided at the bottom of the cup (11) to lead the liquid out.

The present invention also improves the robustness of the manhole cover (2). On the bottom of the cover (2), a beam (23) is provided between the hole (41) and arm (21) and at least one circular girder (24) is also provided thereon. Pluralities of rib (25) are provided about the circular girder (24) for reinforcing the girder (24). With the beam (23), girder (24) and ribs (25) disposed at the inner side of the manhole cover (2), the cover (2) is reinforced structurally against weight caused by vehicles passing above which may deform the manhole cover (2).

Figure 4:
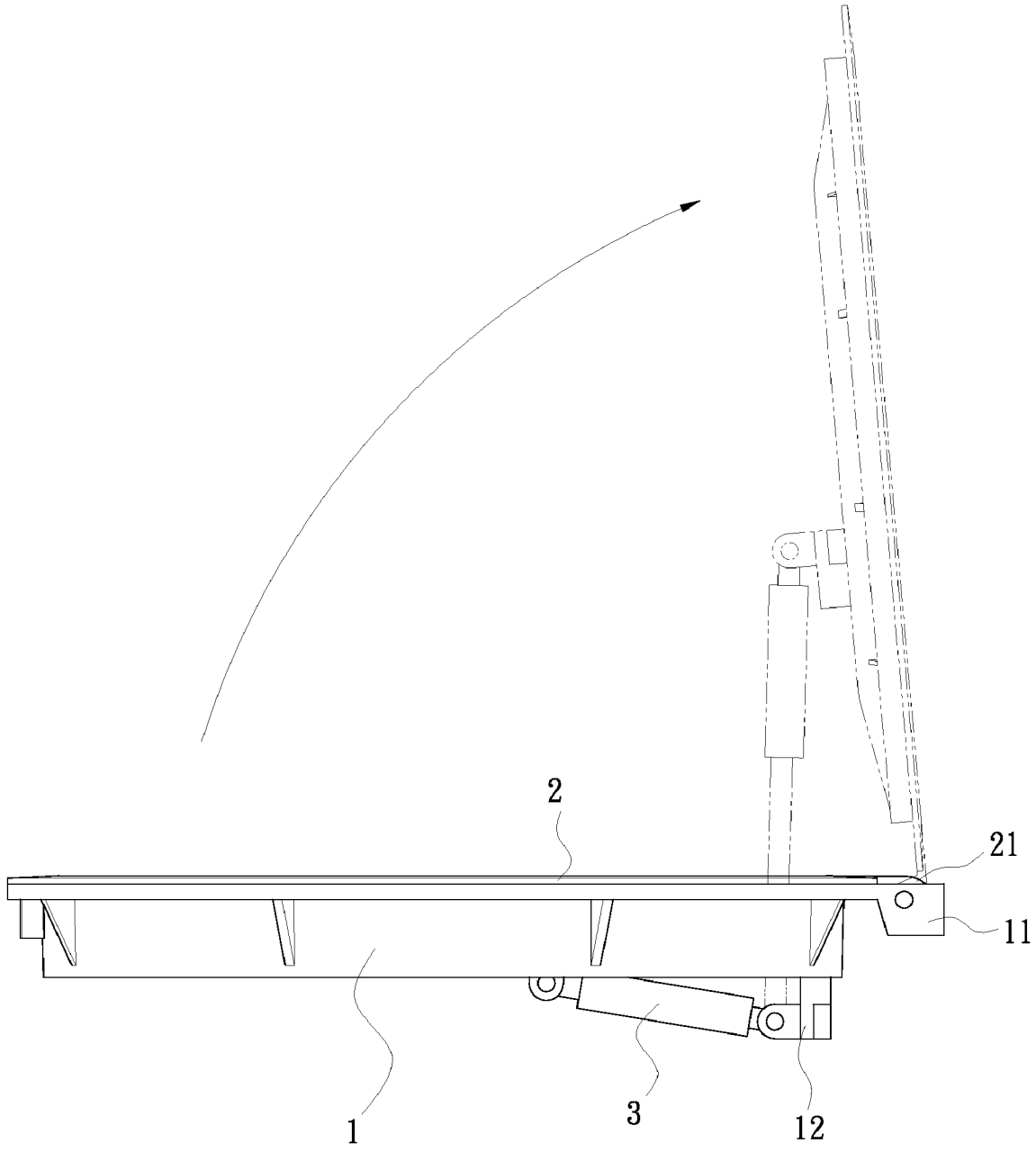
FIG. 4 is a side elevational view of the preferred embodiment of the present invention showing the opening of the manhole covered assisted by a hydraulic device in cut line.

As illustrated in FIG. 4, when a maintenance personnel needs to gain access to the underground structure to perform the duty, He or she only needs to release the locking unit (42) to disengage the manhole cover (2) from the manhole frame (1). The hydraulic device (3) which both end are fixed with the cover (2) and frame (1) will provide an auxiliary force to lift the cover (2), so the user requires only small amount of strength to open the lid and when the duty is over, user can close the lid as easy as to open it and reengage the locking unit (42) to close the cover (2).

The invention claimed is:

1. An easy-lift manhole assembly comprising a circular frame (1) with a cup (11) provided on an end, and a cover (2) with an arm (21) which joints said cup (11) provided on an end thereof, characterized in that: a first bracket (12) is disposed in an inner wall of the frame (1) where the cup (11) is provided, and a second bracket (22) is provided on a bottom of the cover (2); a hydraulic device (3) is provide therebetween and joints with the first and second brackets (12, 22) respectively, and a locking mechanism (4) is disposed on an opposite end of the arm (21) for sealing the cover (2) and frame (1) tightly.

2. An easy-lift manhole assembly of claim 1 wherein said locking mechanism (4) including a hole (41) provided on the cover (2), a locking unit (42) disposed inside the hole (42), a support (44) provided with a passage hole (45) for receiving the locking unit (42) and a slot (43) provided on the inner wall of the frame (1) for engaging with the support (44).

3. An easy-lift manhole assembly of claim 1 wherein the locking unit (42) is coupled with a gasket (46).

4. An easy-lift manhole assembly of claim 1 wherein said cup (11) comprising a water outlet (14).

5. An easy-lift manhole assembly of claim 1 wherein said frame (1) includes a groove (15) which connects with the cup (11).

6. An easy-lift manhole assembly of claim 1 wherein a beam (23) is provided on the bottom of the cover (2) between the hole (41) and arm (21).

7. An easy-lift manhole assembly of claim 1 wherein at least one circular girder (24) is provided on the bottom of the cover (2).

8. An easy-lift manhole assembly of claim 1 wherein pluralities of rib (25) are provided about the circular girder (24) as reinforcement.

* * * * *